US011041695B2

(12) United States Patent
Libotte et al.

(10) Patent No.: US 11,041,695 B2
(45) Date of Patent: Jun. 22, 2021

(54) AIMING DEVICE AND METHOD

(71) Applicant: FN Herstal S.A., Herstal (BE)

(72) Inventors: Hugues Libotte, Jalhay (BE); Kristof Verjans, Tongeren (BE)

(73) Assignee: FN HERSTAL S.A., Herstal (BE)

( * ) Notice: Subject to any disclaimer, the term of this patent is extended or adjusted under 35 U.S.C. 154(b) by 159 days.

(21) Appl. No.: 16/317,272

(22) PCT Filed: Jul. 11, 2017

(86) PCT No.: PCT/EP2017/067431
§ 371 (c)(1),
(2) Date: Jan. 11, 2019

(87) PCT Pub. No.: WO2018/011220
PCT Pub. Date: Jan. 18, 2018

(65) Prior Publication Data

US 2020/0386519 A1 Dec. 10, 2020

(30) Foreign Application Priority Data

Jul. 15, 2016 (BE) ..... 2016/5593

(51) Int. Cl.
*F41G 1/48* (2006.01)
*F41G 1/38* (2006.01)
*F41G 5/06* (2006.01)

(52) U.S. Cl.
CPC ..... *F41G 1/48* (2013.01); *F41G 1/38* (2013.01); *F41G 5/06* (2013.01)

(58) Field of Classification Search
CPC ..... F41G 1/30; F41G 1/38; F41G 1/48
See application file for complete search history.

(56) References Cited

U.S. PATENT DOCUMENTS 4,531,299 A * 7/1985 Wolfe ..... G01C 9/00 33/301
7,225,578 B2 * 6/2007 Tai ..... F41G 1/30 33/334
7,797,873 B2 * 9/2010 Gering ..... F41G 1/34 42/105
8,578,646 B2 * 11/2013 Joannes ..... F41G 1/30 42/113
9,057,587 B2 * 6/2015 Roman ..... F41G 1/467
(Continued)

FOREIGN PATENT DOCUMENTS

EP 1818645 A1 8/2007

OTHER PUBLICATIONS

International Search Report in International Application No. PCT/EP2017/067431 dated Sep. 20, 2017.

*Primary Examiner* — Joshua T Semick
(74) *Attorney, Agent, or Firm* — Leydig, Voit & Mayer, Ltd.; Gerald T. Gray

(57) ABSTRACT

The present invention relates to a firearm aiming system comprising: an inclinometer measuring at least the angle of elevation of the weapon; a computer comprising a memory of an initial angle of elevation; a ballistics chart included in the computer, which matches a shooting distance with an angle of elevation (a) relative to the initial angle of elevation; a first display device which, when in use, displays for the user the shooting distance as a function of the initial angle of elevation and the instantaneous angle of elevation.

7 Claims, 6 Drawing Sheets

(56) References Cited

U.S. PATENT DOCUMENTS

| | | | | |
|---|---|---|---|---|
| 9,500,442 | B2 * | 11/2016 | Collin | G02B 23/2461 |
| 9,746,286 | B2 * | 8/2017 | Piepmeyer | F41G 11/003 |
| 2005/0241207 | A1 * | 11/2005 | Staley, III | F41G 3/065 42/105 |
| 2016/0169621 | A1 * | 6/2016 | Geva | F41G 3/06 42/118 |

* cited by examiner

AIMING DEVICE AND METHOD

FIELD OF THE INVENTION

The present invention relates to an electronic aiming device and an aiming method using such a device. The device of the invention is particularly suited to the firing of munitions having a parabolic trajectory (i.e. having a substantial difference between the aiming angle and the sighting angle).

BACKGROUND

All aiming systems require knowledge of the distance. This is particularly true for projectiles having a highly curved (parabolic) trajectory, since in this case the aiming line and the sight line may be very different.

According to the prior art, this distance may be entered either automatically (communication between the aiming system and a rangefinder) or manually. In the first case, the system in question is more complex since it involves an aiming system and a rangefinder, which may or may not be combined. Here, the case of a standalone aiming system without communication with another electronic system is considered. Consequently, in order to use the aiming system, the firer must be kept updated as to the distance from the target either by a partner or by estimation. With the exception of the case of aiming systems having a complete (mechanical, holographic, etc.) grid sight, and hence lower resolution, this distance must then be entered manually into the aiming system so that it positions the aiming means at the desired angle. It should also be emphasized that aiming systems having a complete (mechanical or electronic) grid sight generally have lower resolution and do not allow multiple ballistics charts to be taken into account.

An example of an aiming system for parabolic firing is described in the patent document EP 1 818 645. In this document, a movable red dot is placed at an adequate sighting angle, according to the predetermined distance, such that superposition of the red dot over the target provides a correct range for the munition.

SUMMARY OF THE INVENTION

The present invention relates to an aiming system for a firearm comprising:

- a clinometer measuring at least the angle of elevation of the firearm;
- a computer comprising a memory of an initial angle of elevation;
- a ballistics chart included in the computer, which matches a firing distance with an angle of elevation ($\alpha$) relative to the initial angle of elevation;
- a first display device which, when in use, displays for the user the firing distance as a function of the initial angle of elevation and the instantaneous angle of elevation.

According to preferred embodiments of the invention, the aiming system of the invention comprises one, or a suitable combination, of at least two of the following features:

- the aiming system comprises a second display device indicating the vertical bore axis;
- the system comprises movable designation means, the computer being arranged to move, when in use, said designation means along a vertical axis so as to keep said designation means at the initial angle of elevation;
- the movable designation means are selected from the group consisting of a red dot, a reticle and a pointer;

- the system comprises a low-pass frequency filter between the clinometer and the computer, so as to stabilize the inclination measurement;
- the system comprises means for laterally moving the display of the vertical axis of the firearm or the movable designation means, so as to apply an azimuthal correction for the Magnus effect and/or for the cant angle;
- the system comprises a second clinometer that is connected to the computer, measuring the cant angle of the firearm, the display means indicating to the user when the cant angle compensates for the Magnus effect for the displayed distance;
- the system comprises optical magnification means, and tracking means that are arranged to keep, when in use, the area of magnification at the initial angle of elevation;
- the system comprises a semitransparent surface superposing over the target an image at infinity of a screen displaying the distance.

A second aspect of the invention relates to an aiming method for a firearm using the aiming system of the invention, comprising the following steps:

- determining the distance from a target;
- marking the angle of elevation of the target;
- increasing the angle of elevation of the firearm until the distance from the target is displayed, adequate aim being achieved when the displayed distance corresponds to the displayed distance.

KEY

Figure 1:
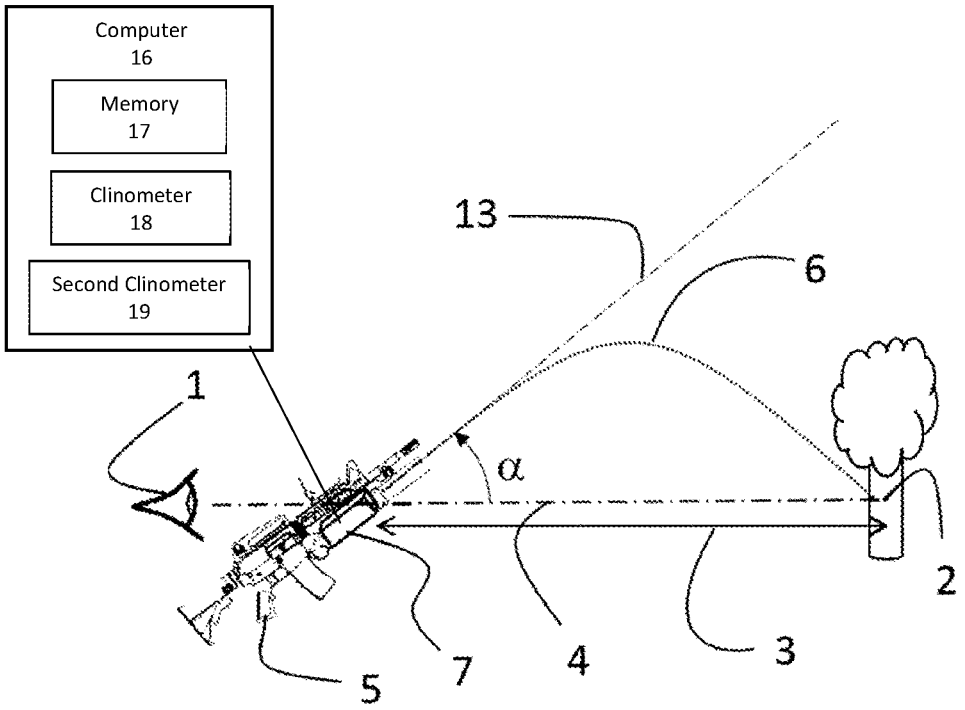
FIG. 1 schematically shows the general parameters of a parabolic trajectory.

1. User
2. Target
3. Distance from the target (range)
4. Sight axis
5. Firearm
6. Trajectory
7. Aiming device
8. Movable red dot or reticle
9. Display of the lock state (in the non-locked state)
10. Initial digital display of the distance
11. Digital display of the range
12. Display of the lock state (in the locked state)
13. Bore axis
14. Second display device
15. First display device
16. Computer
17. Memory
18. Clinometer
19. Second clinometer
20. Fixed vertical reticle
21. Initial display of the distance
22. Display of the range
28. Fixed red dot or reticle
30. Display screen
31. Lens
32. Fixed mirror for redirecting the image from the display
34. Semireflective plate
41. Off-center red dot for movement of the movable red dot or reticle
50. Movable mirror
51. Axis of rotation of the movable mirror
60. Tracking mirror
61. Objective lens
62. Semitransparent redirecting mirror
63. Eyepiece lens
65. Light source for designation or illumination (in the focal plane of the objective lens)
70. Reflective tracking prism
71, 72, 74. Redirecting mirrors
73. Semireflective mirror
75. Axis of rotation of the prism 70.

DETAILED DESCRIPTION

The principle of the invention is to display the range of a munition as a function of the angle α formed between the sight axis 4 and the bore axis 13 to a user in real time. These basic firing parameters are shown in FIG. 1. According to the invention, the aiming device comprises a clinometer and a computer comprising the ballistics chart for the munition in question. To determine the firing conditions, the user 1 first determines the sight line 4. In the case in which the sight line 4 is not horizontal, the firer must mark (or lock) this sight line 4. It may be marked in various ways, such as by pressing a button, by holding this sight line for a given time, or by any other means (voice command, blinking an eye, etc.) allowing the system to decide that it does indeed signify the designation of a target.

The elevation of this sight line is then memorized by the computer. A display 10, 21 then initially indicates a range of zero to the user. During the marking operation, an indicator light may advantageously switch from an off state 9 signifying that the sight line has not been locked to an on state 12 indicating that the sight line has been locked.

Figure 2:
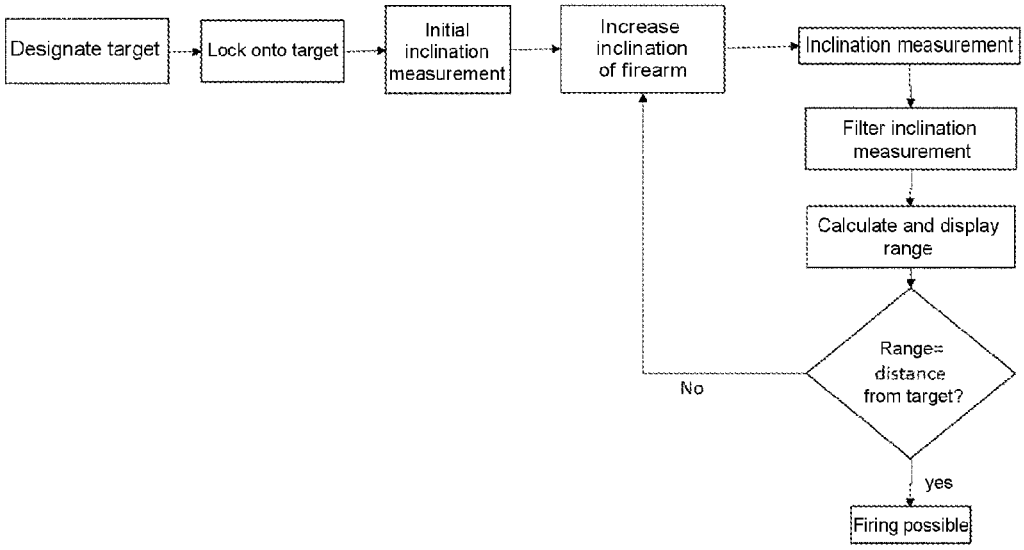
FIG. 2 schematically shows the general algorithm for a firing system using the aiming system of the invention.

Once this sight line has been locked, the firer simply has to increase the angle of elevation of the firearm until the displayed distance 11, 22 corresponds to the distance from the target. The general principle of this firing mode is shown in FIG. 2.

During this vertical movement, a change in the azimuthal direction of the firearm 5 by the firer should be avoided. The simplest way to achieve this is to use a point of reference such as a vertical reticle projected to infinity by a suitable device and superposed visually over the target, such as shown in FIG. 3.

Figure 3:
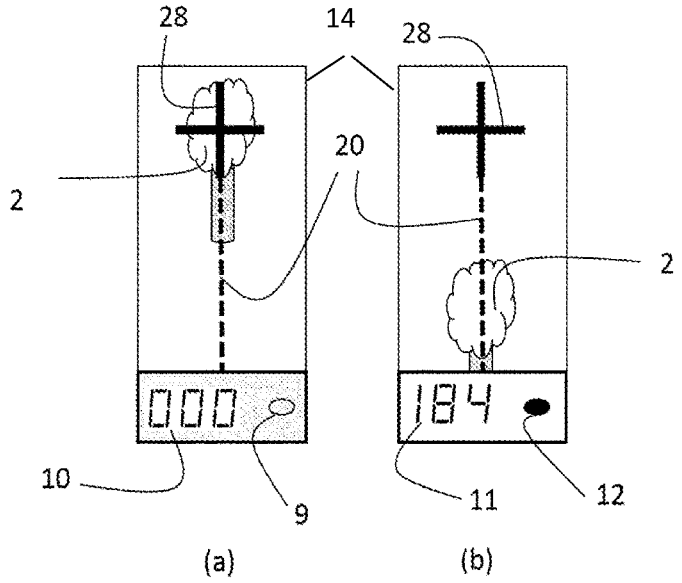
FIG. 3 schematically shows one example of the display of the parameters superposed over the environment, as perceived by the user. (a) when locking onto the target, (b), when firing.

FIG. 3 shows the simplest mode of implementation of the invention, having the advantage of using no moving parts. In FIG. 3*a*, the user designates the target by means of a fixed reticle 28 and marks the target. The indicated distance 10 is then 0 and the indicator light 9 is initially off. Next, as shown in FIG. 3*b*, the user locks the sight line and raises the firearm while keeping the target in the vertical fixed reticle 20 until the predetermined distance is displayed.

Figure 5:
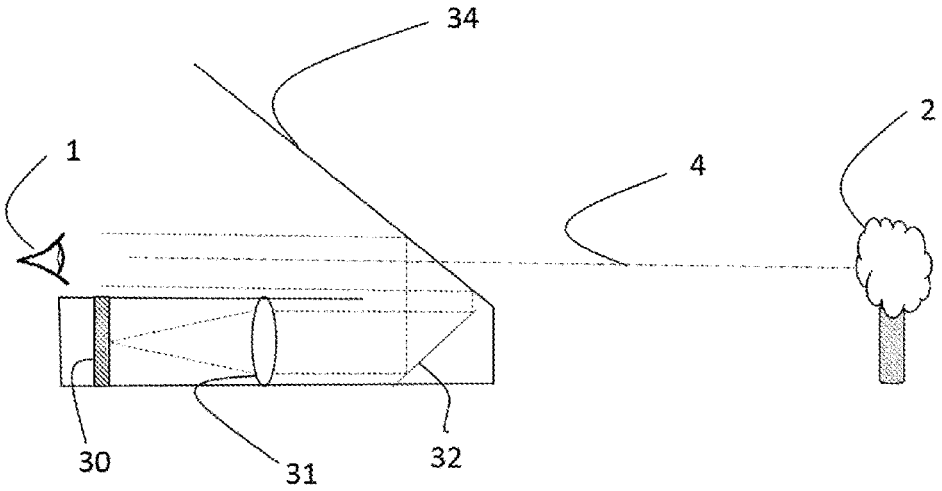
FIG. 5 schematically shows one example of a device for displaying the range according to the invention, in the position for locking onto the target.

The display from FIG. 3 may for example be provided by the device from FIG. 5. In this figure, a display screen 30 is placed at the focal point of a lens 31, and the image of the display screen 30 at infinity is redirected via a fixed redirecting mirror 32 to a semireflective device 34 allowing the image of the screen to be superposed over the image of the target in the sight of the user 1. The semireflective device may for example comprise a simple semireflective plate, a prism, or a cube formed of two prisms and comprising a semireflective diagonal.

In this embodiment, the visual field over which the display is superposed must be large enough to keep the display of the distance 11 and the vertical reticle 20 visible and superposed over the target 2 regardless of the elevation.

The display screen 30 may for example comprise a simple LED display such as shown in FIG. 3, a vertical linear LED for visually representing the vertical reticle 20 and a horizontal LED forming, with the vertical LED, the reticle 28. Alternatively, the display screen 30 comprises a small, high-resolution matrix display in order to limit the bulk of the device. Such a system affords the display greater flexibility, but generally has the drawback of increased energy consumption. The computer must also, in this case, comprise more sophisticated graphics means (GPU).

Figure 4:
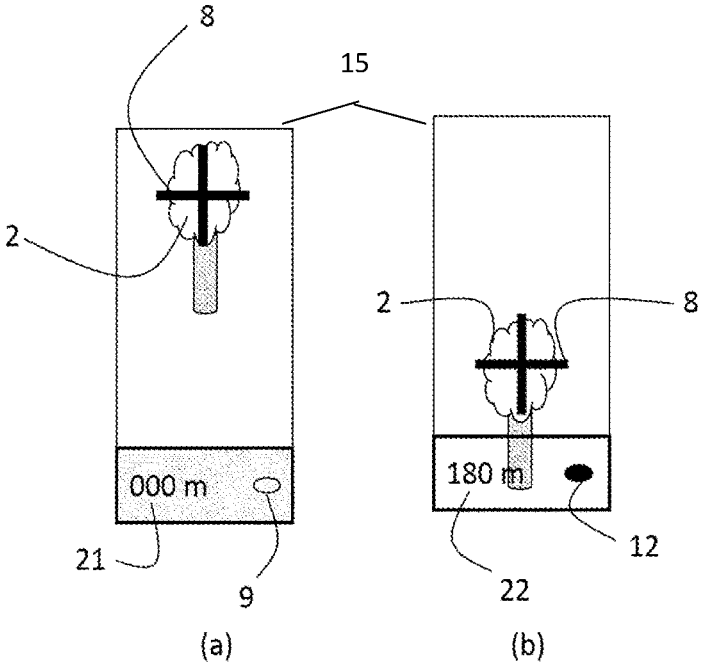
FIG. 4 schematically shows another example of the display of the parameters superposed over the environment, as perceived by the user. (a) when locking onto the target, (b), when firing.

According to a more sophisticated embodiment of the invention as shown in FIG. 4, when raising the firearm after lock, the designation reticle 8 tracks the aiming line by means of a tracking device, the computer moving the reticle 8 vertically in real time so as to track the target on the sight line. The display of the distance may (as in FIG. 4*b*) or may not track an equivalent movement in the visual field. In this case, once in firing position, the firer aligns the reticle with the target until the displayed distance is suitable for the firer. In practice, the position of the reticle is controlled and stabilized by means of a PID controller, for example, so that it is kept aligned with the firing line defined by the firer at the start.

Figure 6:
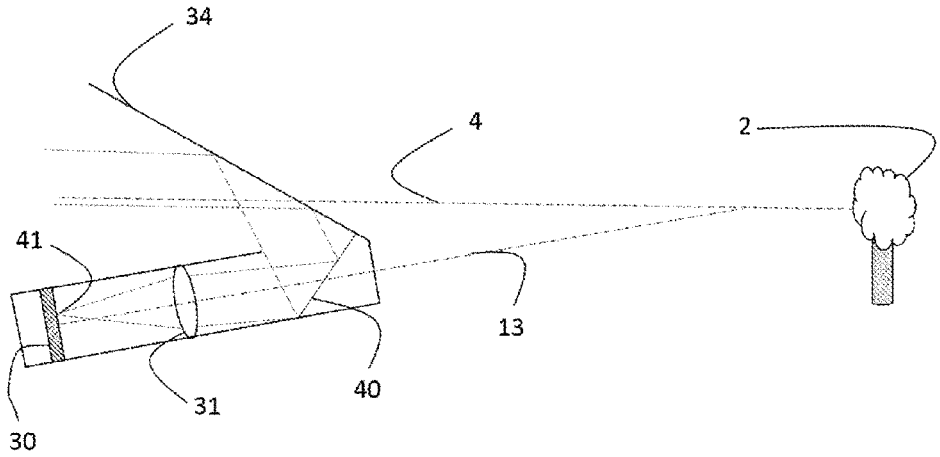
FIG. 6 schematically shows another example of a device for displaying a range according to the invention, in firing position.

In this case, the tracking may also be provided by the device from FIG. 5. It is then sufficient to move the representation of the reticle 41 over the display device 30. For example, it may be moved simply by moving the image of the reticle over the high-resolution matrix display such as described above. This movement is shown in FIG. 6.

Figure 7:
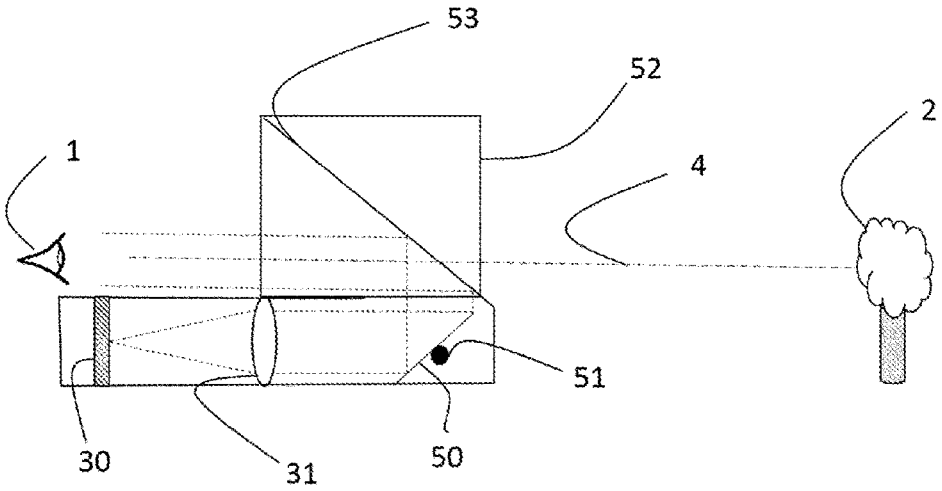
FIG. 7 schematically shows another example of a device for displaying the range according to the invention, in the position for locking onto the target.
Figure 8:
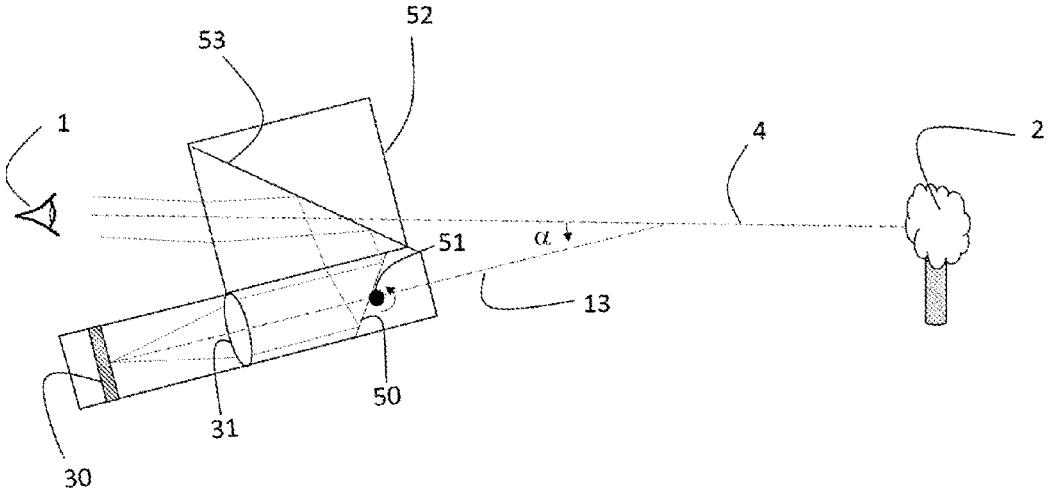
FIG. 8 schematically shows another example of a device for displaying a range according to the invention, in firing position.

Preferably, the tracking device, such as shown in FIGS. 7 and 8, comprises a movable redirecting mirror 50 rotating about a horizontal axis 51 allowing the sighting angle of the display to be adjusted.

Regardless of whether the redirecting mirror is fixed or movable, the semitransparent device allowing the reticle and the display to be superposed over the target may advantageously comprise a splitter cube 52 comprising two prisms separated by a splitter plate 53. This type of cube is used both to improve the robustness of the superposing plate and to decrease the bulk of the system. Specifically, refractions of the projected image of the screen at the entrance and at the exit of the prism have the effect of decreasing the movement of the corresponding light beams over the splitter plate 53, thus decreasing the required length of the splitter plate 53. The second prism, on the target side, allows the chromatic distortions of the image of the target caused by refraction to be removed.

Figure 9:
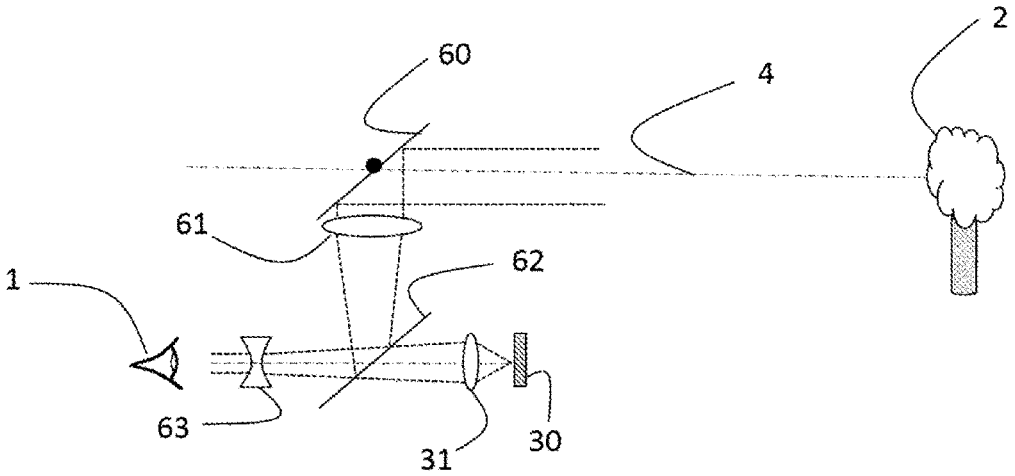
FIG. 9 schematically shows one example of a device for displaying a range according to the invention comprising optical magnification means, in the position for locking onto the target.
Figure 10:
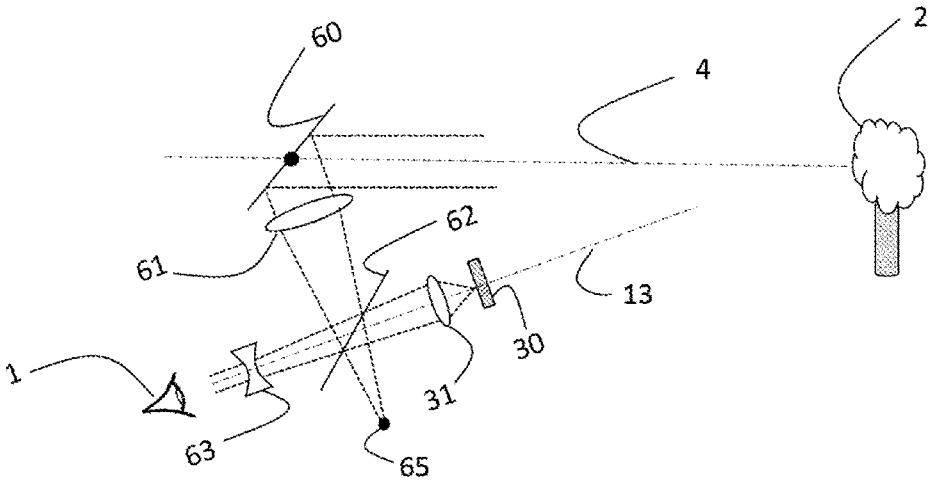
FIG. 10 schematically shows another example of a device for displaying the range according to the invention comprising optical magnification means, in firing position, this device having both a movable reticle and a device for designating/illuminating the target.

Advantageously, the device of the invention may be incorporated within a target magnification device such as shown in FIGS. 9 and 10. In this case, the system advantageously comprises a tracking mirror 60 that is able to rotate about a horizontal axis, redirecting the sight axis 4 onto the optical axis 64 of an objective lens 61, the computer comprising means for controlling the rotation of the tracking mirror 60 that are arranged to keep, once the elevation has been locked, the aiming axis 4 redirected onto the optical axis 64 of the objective lens 61.

In this case, the display device may advantageously be placed behind a semitransparent plate 62 that redirects the optical axis 64 from the objective lens 61 onto an eyepiece lens 63, the display screen 30 being placed in a conjugate plane of the focal plane of the eyepiece lens 63 so as to project the image of the display screen 30 to infinity.

Advantageously, as shown in FIG. 10, an illuminator/pointer 65 may be placed in the extension of the optical axis 64 of the objective lens 61, and at the focal point thereof so as to illuminate the target 2.

Conventionally, the eyepiece lens 63 is a divergent lens, forming what is termed a Galilean scope geometry with the objective lens, allowing an upright image to be formed. Of course, the term "eyepiece lens" is understood to mean a simple divergent lens, or an assembly of achromatic lenses such as an achromatic doublet or triplet, well known to those skilled in the art.

Alternatively, the eyepiece 63 may be a convergent lens forming what is termed a Keplerian geometry with the objective lens. In this case, a device for rectifying the image is generally used. This type of geometry makes it possible to place a fixed (passive) reticule at the focal point of the objective lens and a passive LCD digital display, thereby allowing the consumption of the device to be decreased.

When magnification is used, it may be desirable to keep the gaze of the user on the axis of the sight line 4 rather than along the aiming axis 13. In this case, two additional redirecting mirrors are used, the mirror redirecting to the user being movable and slaved to the tracking mirror 60, these two mirrors being arranged to keep an angle of 90° between them.

Figure 11:
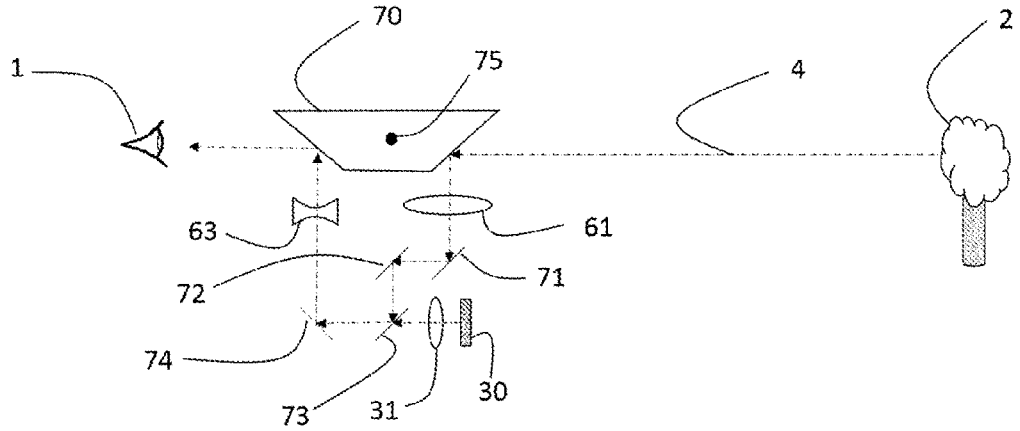
FIG. 11 schematically shows another example of a device for displaying the range according to the invention comprising optical magnification means, in the position for locking onto the target.
Figure 12:
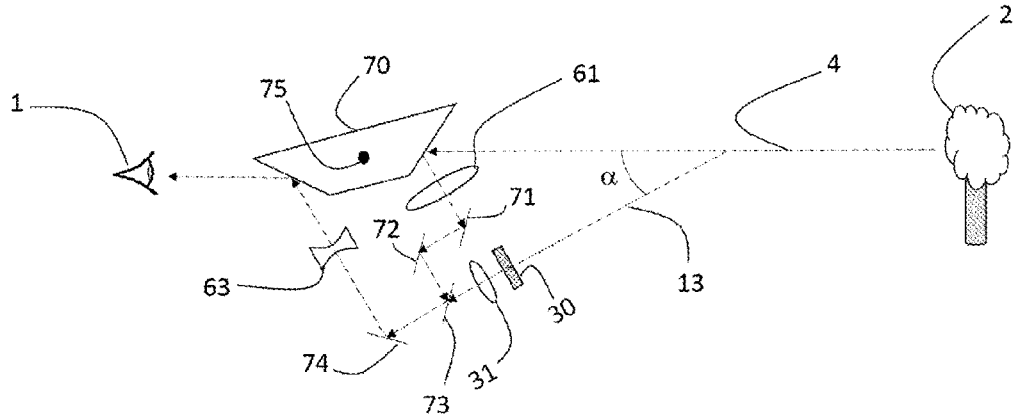
FIG. 12 schematically shows the device for displaying the range from FIG. 11 in firing position.

An exemplary embodiment of such a device is shown in FIG. 11. In this device, the abovementioned slaving of the mirror redirecting to the user to the tracking mirror is provided by using two faces of one and the same reflective prism 70. When the device is locked onto the elevation of the sight line, the angle of elevation is tracked by rotating the prism 70 on its axis 75. When the angle of elevation increases by a value a, the prism rotates by $\alpha/2$. The image of the target is next reflected toward the objective lens 61 and then successively redirected by the mirrors 71, 72, 73, 74, one of these being semitransparent so as to superpose the display of the display screen 30 located in a conjugate plane of the focal plane of the eyepiece lens 63. The advantage of the geometry presented in FIG. 11 is that it provides minimal bulk.

Advantageously, the device of the invention comprises a low-pass frequency filter allowing the noise caused by involuntary small movements of the firer (parasitic vibrations) to be decreased so that they do not affect the readability of the displayed distance.

One advantage of the invention is that it makes it possible not to have to manually enter the distance into the aiming system. It also makes it possible to benefit from the possibility of using different ballistics charts according to the projectile being used without modifying hardware, unlike in mechanical aiming systems.

Advantageously, the device of the invention also comprises means for applying an azimuthal correction for the Magnus effect. For example, the movable reticle or the vertical reticle may be moved laterally according to the calculated distance.

Alternatively, the Magnus effect may be corrected for by modifying the cant angle. In this case, the device of the invention comprises a clinometer measuring the cant angle, the computer determining, as a function of the displayed range, the ideal cant angle (i.e. that correcting for the Magnus effect). The display then comprises an indicator indicating to the firer whether or not the tilt is adequate. For example, the display comprises two indicator lights indicating in which direction the user should increase the cant angle, these indicator lights turning off to indicate an adequate angle.

The invention claimed is:

1. An aiming system for a firearm comprising:

a clinometer configured to measure at least an angle of elevation of the firearm;

a computer comprising a memory storing an initial angle of elevation of the firearm;

a ballistics chart included in the memory of the computer, wherein the ballistics chart maps a range of a munition with an angle of elevation ($\alpha$) relative to the initial angle of elevation;

a first display device which, when in use, displays for a user a calculated range of the munition based on the initial angle of elevation and an instantaneous angle of elevation of the firearm;

a semitransparent surface superposing over the target an image at infinity of a screen displaying the calculated range; and movable designation means, the computer being arranged to move, when in use, said movable designation means along a vertical axis so as to keep said movable designation means at the initial angle of elevation.

2. The aiming system as claimed in claim 1, comprising a second display device indicating a vertical bore axis.

3. The aiming system as claimed in claim 1, wherein said movable designation means are selected from the group consisting of a red dot, a reticle and a pointer.

4. The aiming system as claimed in claim 1, further comprising a low-pass frequency filter between the clinometer and the computer, operable to stabilize an inclination measurement.

5. The aiming system as claimed in claim 1, a display that moves on a vertical axis of the firearm or the movable designation means, so as to apply an azimuthal correction for the Magnus effect and/or for a cant angle of the firearm.

6. The aiming system as claimed in claim 5, further comprising a second clinometer that is connected to the computer, and configured to measure the cant angle of the firearm, the first display device indicating to the user when the cant angle compensates for the Magnus effect for the displayed distance.

7. The aiming system as claimed in claim 6, further comprising an optical train comprising one or more lenses capable of magnifying an image, and a mirror that is able to rotate about a horizontal axis and that is arranged to keep, when in use, an area of magnification at the initial angle of elevation.

* * * * *